US010513383B2

(12) United States Patent
Bélanger

(10) Patent No.: US 10,513,383 B2
(45) Date of Patent: Dec. 24, 2019

(54) CORNER PROTECTOR

(71) Applicant: CORRUVEN CANADA INC., Kedgwick (CA)

(72) Inventor: Alain Bélanger, Kedgwick (CA)

(73) Assignee: CORRUVEN CANADA INC., Kedgwick (CA)

( * ) Notice: Subject to any disclaimer, the term of this patent is extended or adjusted under 35 U.S.C. 154(b) by 97 days.

(21) Appl. No.: 15/715,431

(22) Filed: Sep. 26, 2017

(65) Prior Publication Data

US 2018/0086532 A1 Mar. 29, 2018

Related U.S. Application Data

(60) Provisional application No. 62/416,304, filed on Nov. 2, 2016, provisional application No. 62/399,546, filed on Sep. 26, 2016.

(51) Int. Cl.
*B65D 81/05* (2006.01)

(52) U.S. Cl.
CPC ..... *B65D 81/053* (2013.01); *B65D 81/055* (2013.01)

(58) Field of Classification Search
CPC ..... B65D 81/02; B65D 81/05; B65D 81/053; B65D 81/054; B65D 81/055; B65D 85/30
USPC ..... 206/453, 586
See application file for complete search history.

(56) References Cited

U.S. PATENT DOCUMENTS 4,244,471 A * 1/1981 Plante ..... B65D 19/0018 206/586
4,784,270 A 11/1988 Layer et al.
4,811,840 A 3/1989 Muyskens
5,794,542 A 8/1998 Besaw
6,186,329 B1 2/2001 Qiu
6,513,662 B1 2/2003 Stebelton
6,561,357 B2 5/2003 Renck
7,128,214 B2 10/2006 Qiu et al.
7,159,345 B2 1/2007 Hunt
7,383,952 B2 6/2008 Kruelle et al.
7,625,616 B2 12/2009 Van de Camp
8,079,476 B2 * 12/2011 Simms ..... B65D 81/054 206/453
8,443,975 B2 5/2013 Butch, Jr. et al.
9,169,063 B2 * 10/2015 Ulrich ..... B65D 90/08
(Continued)

OTHER PUBLICATIONS

DAVPACK The Original Packaging Store "Perforated Cardboard Edge Protectors" Retrieved from the Internet on Aug. 11, 2017 [https://www.davpack.co.uk/protectivepackaging/edgecornerprotection/perforatededgeprotectors.htm].
(Continued)

*Primary Examiner* — Bryon P Gehman
(74) *Attorney, Agent, or Firm* — Norton Rose Fulbright Canada LLP

(57) ABSTRACT

The corner protector has a flexible sheet having an undulated shape with summit portions, valley portions, and intermediate portions each extending between corresponding summit and valley portions. The sheet is foldable along a length of at least one of the summit portions to form a folded shape for the sheet corresponding to a shape of the corner. The valley portions of the sheet in the folded shape are abuttable against side walls of the object intersecting at the corner. An apex section of the summit portion in the folded shape is spaced from the corner of the object upon the valley portions abutting the side walls.

14 Claims, 6 Drawing Sheets

(56) References Cited

U.S. PATENT DOCUMENTS

| | | | | |
|---|---|---|---|---|
| 9,511,920 | B2 | 12/2016 | Baker et al. | |
| 10,124,948 | B2 * | 11/2018 | Baker | B65D 19/00 |
| 2005/0087663 | A1 | 4/2005 | Schroeder | |
| 2010/0072096 | A1 | 3/2010 | Wu et al. | |
| 2015/0307230 | A1 * | 10/2015 | Ulrich | B65D 81/054 206/586 |
| 2017/0107041 | A1 | 4/2017 | Baker et al. | |

OTHER PUBLICATIONS

"Tuff Angle Edge Protectors" Retrieved from the Internet on Aug. 11, 2017 [http://www.edgeprotectors.us/product.html].

* cited by examiner

CORNER PROTECTOR

FIELD

This application claims priority to U.S. provisional patent application No. 62/416,304 filed Nov. 2, 2016, and to U.S. provisional patent application No. 62/399,546 filed Sep. 26, 2016, the entire contents of both of which are incorporated by reference herein.

The application generally relates to protective packaging, and more particularly, to a corner protector.

BACKGROUND

Conventional items for protecting objects, or parts thereof, during transport are either pre-fabricated or formed onsite prior to being applied to the object. Pre-fabricated protective items must be manually or machine formed, typically offsite, and shipped to the location where they will be applied to the object. In their pre-fabricated shapes, the protective items occupy a certain volume and have a certain weight, which increases the costs, volume, and inconvenience associated with transporting them. Protective items formed onsite are often difficult to manipulate, and do not provide adequate protection for the object or part thereof. Furthermore, some conventional protective items, whether they are pre-fabricated or formed onsite, cannot easily adapt to the shape of the object requiring protection.

SUMMARY

In accordance with one aspect, there is provided a corner protector for protecting a corner of an object, comprising: a flexible sheet having an undulated shape with summit portions, valley portions, and intermediate portions each extending between corresponding summit and valley portions, the sheet being foldable along a length of at least one of the summit portions to form a folded shape for the sheet corresponding to a shape of the corner, the valley portions of the sheet in the folded shape being abuttable against side walls of the object intersecting at the corner, an apex section of said summit portion in the folded shape being spaced from the corner of the object upon the valley portions abutting the side walls.

In accordance with another aspect, there is provided a method for protecting a corner of an object, comprising: folding an undulated, flexible sheet along a length of at least one summit portion of the sheet to correspond to a shape of the corner; and positioning the folded sheet about the corner, valley portions of the folded sheet abutting against side walls of the object intersecting at the corner, an apex section of said folded summit portion being spaced from the corner.

Many further features and combinations thereof concerning the present improvements will appear to those skilled in the art following a reading of the instant disclosure.

DETAILED DESCRIPTION

Figure 1A:
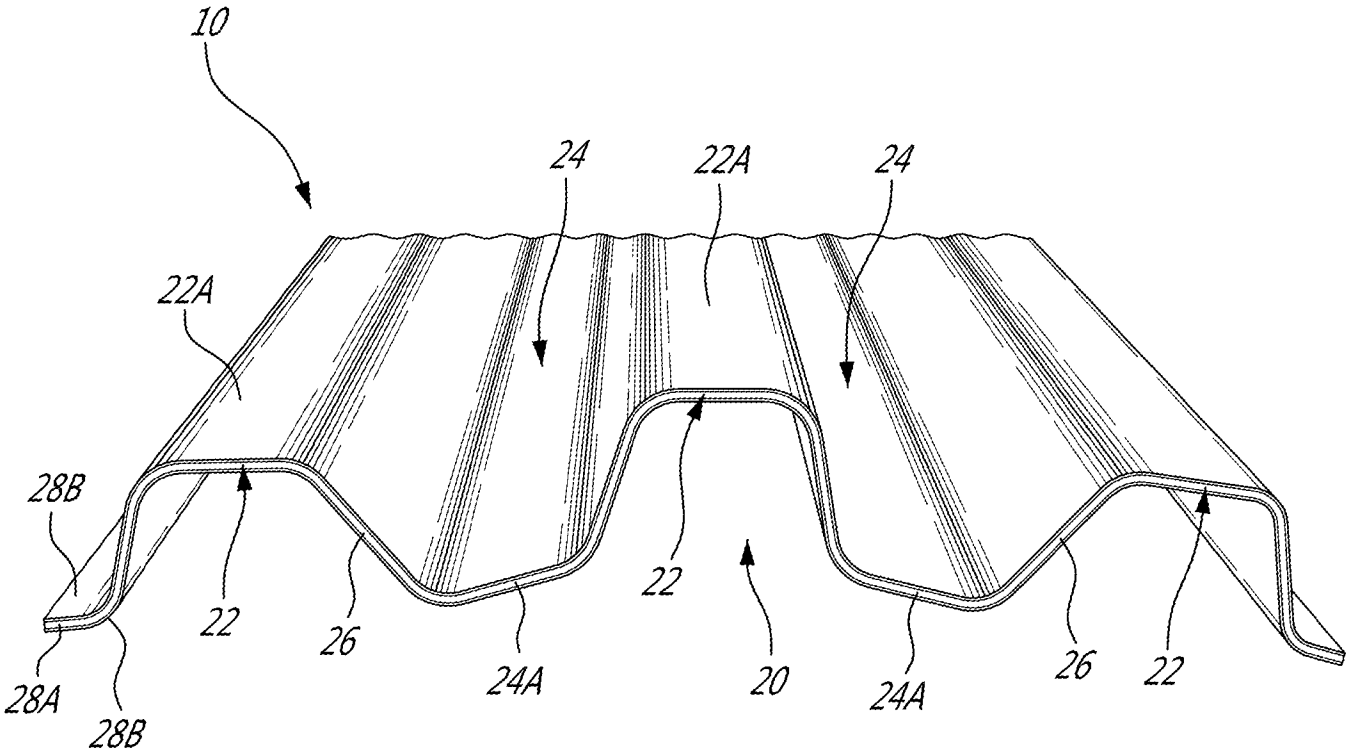
FIG. 1A is a perspective view of a flexible sheet of a corner protector.
Figure 1B:
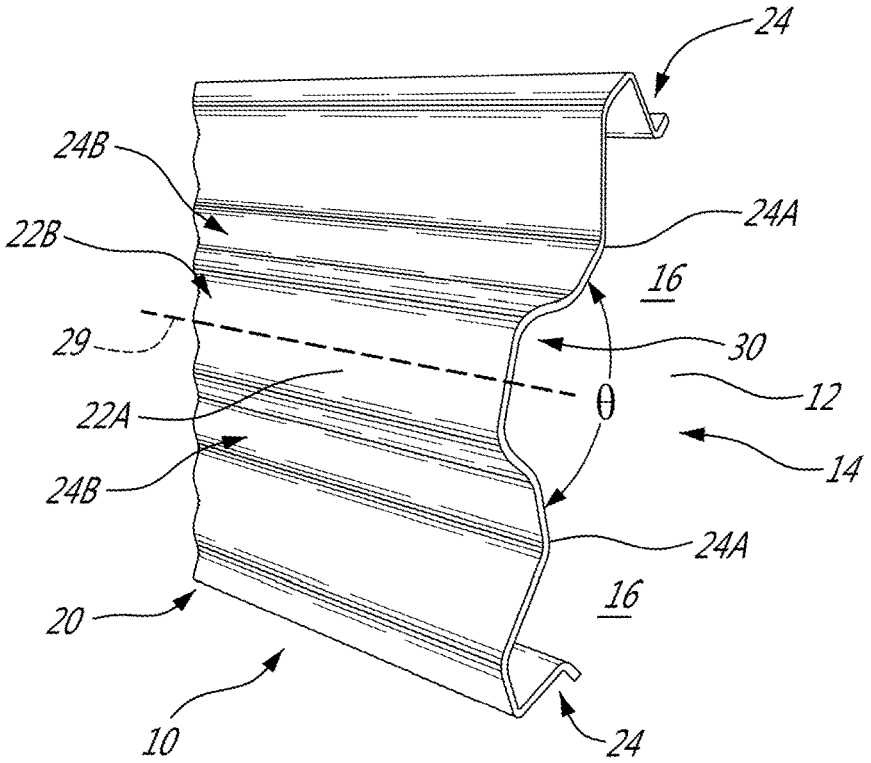
FIG. 1B is a perspective view of the sheet of FIG. 1A in a folded shape and abutted against a corner of an object.
Figure 1C:
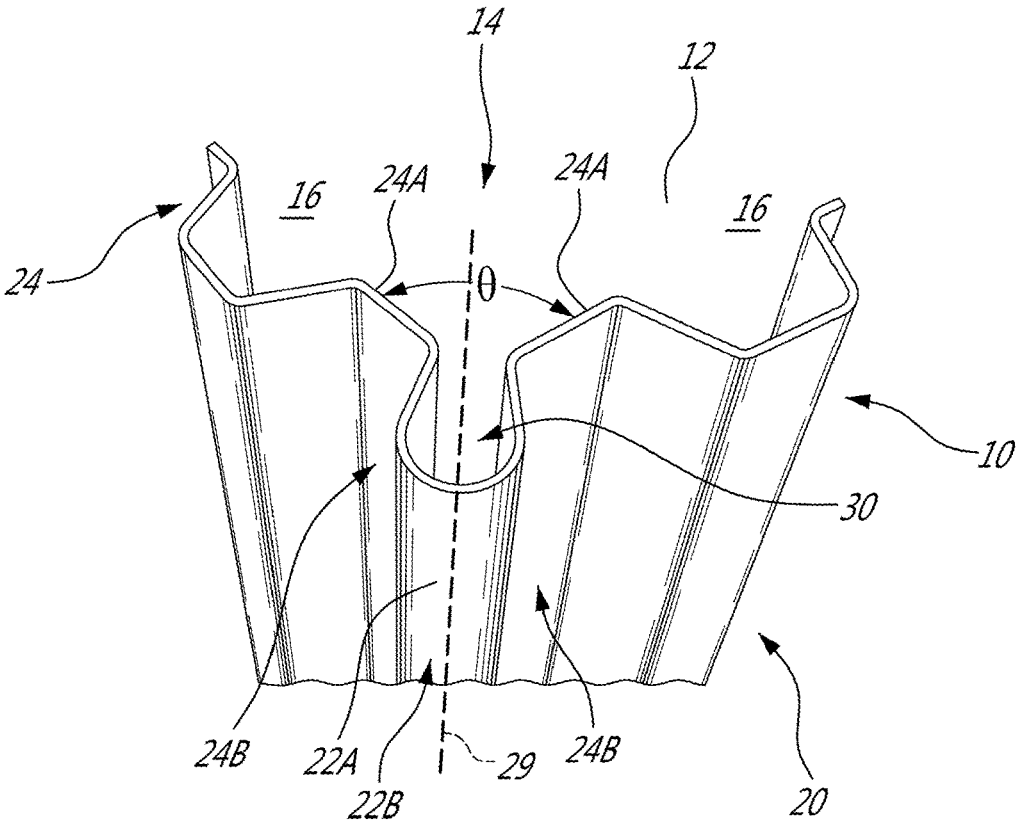
FIG. 1C is a perspective view of the sheet of FIG. 1A in another folded shape and abutted against another corner of another object.

FIGS. 1A to 1C illustrate a corner protector 10. The corner protector 10 is used to protect an object 12. More particularly, the corner protector 10 (sometimes referred to herein as simply "protector 10") is used to protect a corner 14 of the object 12 from impacts and other stresses resulting from transportation of the object 12, for example, that may damage the corner 14 or the object 12. The protector 10 can be used to protect other portions of the object 12 as well. In the depicted embodiment, portions of the protector 10 abut against outer side walls 16 of the object 12, and thus provide protection thereto. It is therefore appreciated that the protector 10 disclosed herein provides a structural corner to be used with or without additional packaging so as to protect the object 12.

The protector 10 is provided in sheet form, and therefore includes a flexible sheet 20. The sheet 20 has an undulated shape. As will be explained in greater detail below, the sheet 20 can be folded and/or manipulated to have a folded shape that corresponds to the shape of the corner 14. The folded shape formed by manipulating the undulated sheet 20 remains substantially rigid after the sheet 20 is manipulated, which provides strength to the sheet 20, and allows it to be used for any suitable protective purpose which requires resistance to loads.

The sheet 20 undulates over its length and/or width. The term "undulated" refers to the sinuous or billowing form of the sheet 20. Although shown in FIG. 1A as having a succession of relatively flat valley portions alternating with relatively flat valley portions, other undulated shapes can be used, such as substantially sinusoidal, corrugated, wave-like, triangular wave, square wave, or any other suitable undulated shape. Irrespective of the form of the undulated sheet 20, it will have summit portions 22, valley portions 24, and intermediate portions 26 that each extend between and connect the summit and valley portions 22, 24. Each summit portion 22 in the depicted embodiment is defined by a curved segment of the sheet 20 and has an apex section 22A at the peak of the summit portion 22. Similarly, each valley portion 24 in the depicted embodiment is defined by a curved segment of the sheet 20 and has a trough section 24A at the bottom of the valley portion 24.

The terms "summit" and "valley" are used herein only for convenience to distinguish between the peaks and troughs of the undulated sheet 20, and that their relative positions can be reversed. It will be appreciated that what constitutes a "summit" and a "valley" can vary depending on the orientation of the sheet 20, and on the position of an observer of the sheet 20, amongst other factors. For example, if the sheet 20 of FIG. 1A is flipped onto its other side, the summit and valley portions 22, 24 will be inversed. Any other suitable term for distinguishing the opposed maxima and minima of the sheet 20 can therefore also be used, and it will therefore be appreciated that the summit and valley portions 22, 24 are not limited to the configuration shown in FIG. 1A.

In the depicted embodiment, the undulations of the sheet 20 are oriented laterally and transverse to the longitudinal axis of the sheet 20. The undulations are also uniform throughout the sheet 20, such that the summit and valley portions 22, 24 are separated by the same distance and have the same height. In alternate embodiments, the undulations of the sheet 20 can vary along the length and/or width of the sheet 20.

Still referring to FIGS. 1A to 1C, the protector 10 can be used for structural applications, such as secured against the corner 14, positioned between a packaging container and the object 12, and other possible uses. More particularly, the sheet 20, which is shown in an unfolded configuration in FIG. 1A, can be folded or wrapped about one or more lines to form the folded shape, as shown in FIGS. 1B and 1C. The folded shape can be any suitable shape that corresponds to a shape formed by the interconnected outer surfaces of the corner 14. Some of these folded shapes include, but are not limited to, an L-shape, an acutely-angled shape, and an obtusely-angled shape. The folded shape can be used in one or more of the above-described structural applications. In its folded shape, the sheet 20 maintains its undulated shape, such that the summit and/or valley portions 22, 24 can abut against the object 12, as described in greater detail below. By maintaining its undulated shape, the sheet 20 provides strength to the folded shape formed thereby. In the depicted embodiment, the sheet 20 is manually folded, which allows it to be quickly formed into the desired folded shape by a user. In alternate embodiments, the sheet 20 is folded or otherwise manipulated using a machine.

In the embodiment of FIGS. 1A to 1C, the flexibility of the sheet 20 is derived from its material composition. More particularly, the sheet 20 is made up of multiple layers 28. The sheet 20 is defined by a rigid inner layer 28A sandwiched between two flexible outer layers 28B. Stated differently, the rigid inner layer 28A is disposed between, and encased by, the flexible outer layers 28B. The rigid inner layer 28A provides structure and strength to the sheet 20, and thus to the shape formed by folding the sheet 20. The rigid inner layer 28A is less flexible than the outer layers, although it will be appreciated that the rigid inner layer 28A can experience a certain amount of resilient flexion when placed under loads. The flexible outer layers 28B cover the rigid inner layer 28A along some or all of its extent. In contrast to the rigid inner layer 28A, the flexible outer layers 28B are pliant and can be bent or folded without breaking. The flexible outer layers 28B are attached to the rigid inner layer 28A with a resin applied to opposite surfaces of the rigid inner layer 28A. It can thus be appreciated that the terms "rigid" and "flexible" are descriptors used herein to describe the relative flexibility of the inner and outer layers 28A, 28B, in that the outer layers 28B are more flexible than the inner layer 28A. This difference in flexibility between the inner and outer layers 28A, 28B allows the sheet 20 to be folded, and also provides strength to the folded shape so formed. It can thus be appreciated that any arrangement of materials, layer orientation, fiber orientation, or other material properties which provide the above-described difference in flexibility between the inner and outer layers 28A, 28B is within the scope of the present disclosure.

Referring to FIGS. 1A to 1C, the sheet 20 is foldable along a length of one or more of the summit portions 22 to form the folded shape. When the sheet 20 is so folded, a fold line 29 is formed along the folded summit portion 22B, which extends along a length of the sheet 20. In most embodiments, but not necessarily all, each fold line 29 will extend along the length of the sheet 20 and parallel to the length of a valley or summit portion 22, 24. In the depicted embodiment, the fold line 29 is formed along the summit portions 22. In alternate embodiments, one or more fold lines 29 can be formed along the sloped surface of the intermediate portions 26 between adjacent summit and valley portions 22, 24. It can thus be appreciated that the fold lines 29 can be formed anywhere on the sheet 20 wherever the sheet 20 is folded to form the folded shape.

Referring to FIGS. 1B and 1C, in the folded shape, the valley portions 24 of the sheet 20 are folded toward one another such that the valley portions 24, or some part thereof, abut against the interconnected side walls 16 intersecting at the corner 14. The valley portions 24 therefore protect the side walls 16 of the corner 14 from impacts in the vicinity of the corner 14, and also help to position the object 12. In the folded shape, and when the valley portions 24 are abutted against the side walls 16, the apex section 22A of the summit portion 22 is spaced apart outwardly from the corner 14. The outwardly spaced apex section 22A in the folded shape therefore forms a protective segment of the summit portion 22 by forming a buffer between the relatively sharp and fragile corner 14 of the object 12 and any impact directed thereagainst. Stated differently, any impact directed toward the corner 14 will first strike the spaced-apart apex section 22A, such that the apex section 22A is expected to absorb and/or dissipate the force of the impact, thereby protecting the corner 14.

Referring to FIG. 1B, the folded shape of the sheet 20 forms generally an L-shape, where the opposed wings of the sheet 20 form an inner angle $\Theta$ of slightly greater than 90°. The valley portions 24B immediately adjacent to the folded summit portion 22B on either side thereof abut the side walls 16 of the object 12. More particularly, the trough section 24A of each adjacent valley portion 24B is in contact with the side walls 16. The valley portions 24 positioned further away from the folded summit portion 22B do not have full trough sections 24A, such that only a portion of these trough sections 24A abut against the side walls 16. The apex section 22A is rounded or curved in the depicted embodiment, which may help to deflect impact forces away from the corner 14.

Referring to FIG. 1C, the folded shape of the sheet 20 forms generally an L-shape, where the opposed wings of the sheet 20 form an inner angle $\Theta$ of about 90°. The valley portions 24B immediately adjacent to the folded summit portion 22B on either side thereof abut the side walls 16 of the object 12. More particularly, the trough section 24A of each adjacent valley portion 24B is in contact with the side walls 16. The valley portions 24 positioned further away from the folded summit portion 22B do not have full trough sections 24A. The apex section 22A is rounded or curved in the depicted embodiment, and is more rounded than the apex section 22A in FIG. 1B. The curved apex section 22A may help to deflect impact forces away from the corner 14.

Still referring to the folded shapes of FIGS. 1B and 1C, the folded summit portion 22B and the adjacent valley portions 24B circumscribe an inner space 30 of the folded summit portion 22B. The corner 14 of the object 12 is insertable into the inner space 30 such that the corner 14 is spaced inwardly from an inner surface of the apex section 22A. A protective air gap is formed in the inner space 30 between the corner 14 and the apex section 22A. This air gap provides cushioning and insulation, and can be filled with material such as foam or concrete if desired. The apex sections 22A of the remaining summit portions 22 are spaced apart from the side walls 16 of the object 14 when the valley portions 24 abut against the side walls 16. This spacing provides additional cushioning and/or insulation, and therefore helps to protect the side walls 16 from impact.

For example, the difference in flexibility between the inner and outer layers 28A, 28B can be achieved through the material composition of each layer 28. In the depicted embodiment, the inner layer 28A includes one or more plies of wood veneer. Each ply of wood veneer is composed of a relatively thin slice of wood. Indeed, the wood veneer may be made by "peeling" a circular wood log or by slicing large blocks of wood. Other techniques are possible. The type of wood used for the wood veneer can vary. The layers of wood veneer can be relatively thin, for example thinner than about 3 mm or 0.125 in. It is observed that the wood veneer provides a relatively stiff resistance to bending in the direction of the orientation of its wood fibers. The outer layers 28B can be any suitable material that seals the resin between the inner layer 28A and the corresponding outer layers 28B. In the depicted embodiment, the outer layers 28B are in the form of a sheet of flexible material. The flexible material of the outer layers 28B can include, but is not limited to, paperboard, kraft paper, or a polymer. The outer layers 28B can also be coloured or be printed upon to provide a desired surface finish to the protector 10 or sheet 20.

The layered construction described above is only an example of a possible sheet 20. The flexible outer layers can be Kraft paper and the inner layer can be one or more wood veneer layer, for instance, with the different layers being adhered to one another by a suitable resin. This layered construction is suitable to being "scored" and folded at the score line, as will be presented in further detail below. Alternately, the undulated sheet 20 can be constituted of a single layer of a material such as plastic, and can be scored or not for folding at the fold line. An additional alternate example would be an undulated sheet 20 consisting of two or more superposed layers of relatively flexible material such as Kraft paper, adhered to one another by resin between the layers and extending into the pores of the adjacent Kraft paper sheets. The resin can harden and provide a certain amount of rigidity to the sheet.

Figure 2A:
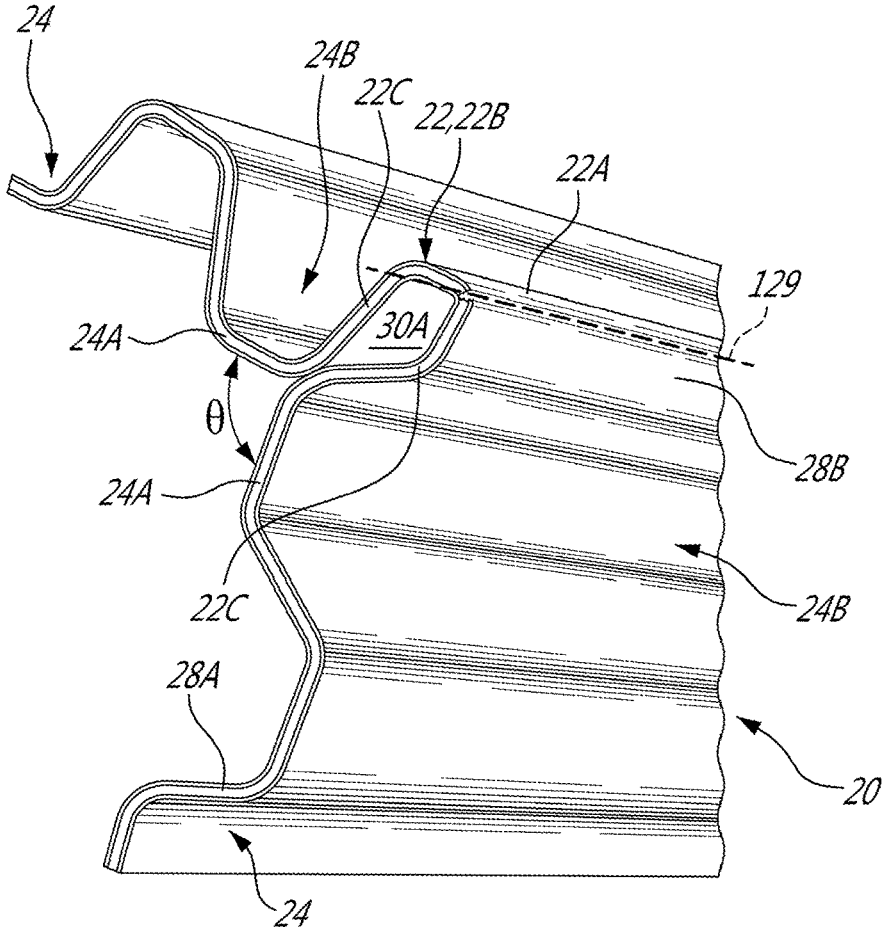
FIG. 2A is a perspective view of the sheet of FIG. 1A with a score line in yet another folded shape.

Referring to FIG. 2A, the fold line 129 is defined by scoring a length of the apex section 22A of the summit portion 22 to be folded. The scored fold line 129 defines an axis about which the summit portion 22 is foldable. In the depicted embodiment, the scored fold line 129 is defined by cutting through one of the flexible outer layers 28B and the rigid inner layer 28A of the summit portion 22. The folded shape of the sheet 20 forms generally an L-shape, where the opposed wings of the sheet 20 form an inner angle $\Theta$ of about 90°. The valley portions 24B immediately adjacent to the folded summit portion 22B on either side thereof are abuttable against the side walls 16 of the object 12. More particularly, the trough section 24A of each adjacent valley portion 24B can be placed in contact with the side walls 16. The valley portions 24 positioned further away from the folded summit portion 22B do not have full trough sections 24A, such that only a portion of these trough sections 24A can abut against the side walls 16. The apex section 22A is relatively pointed in the depicted embodiment, which may help to deflect impact forces away from the corner 14.

Figure 2B:
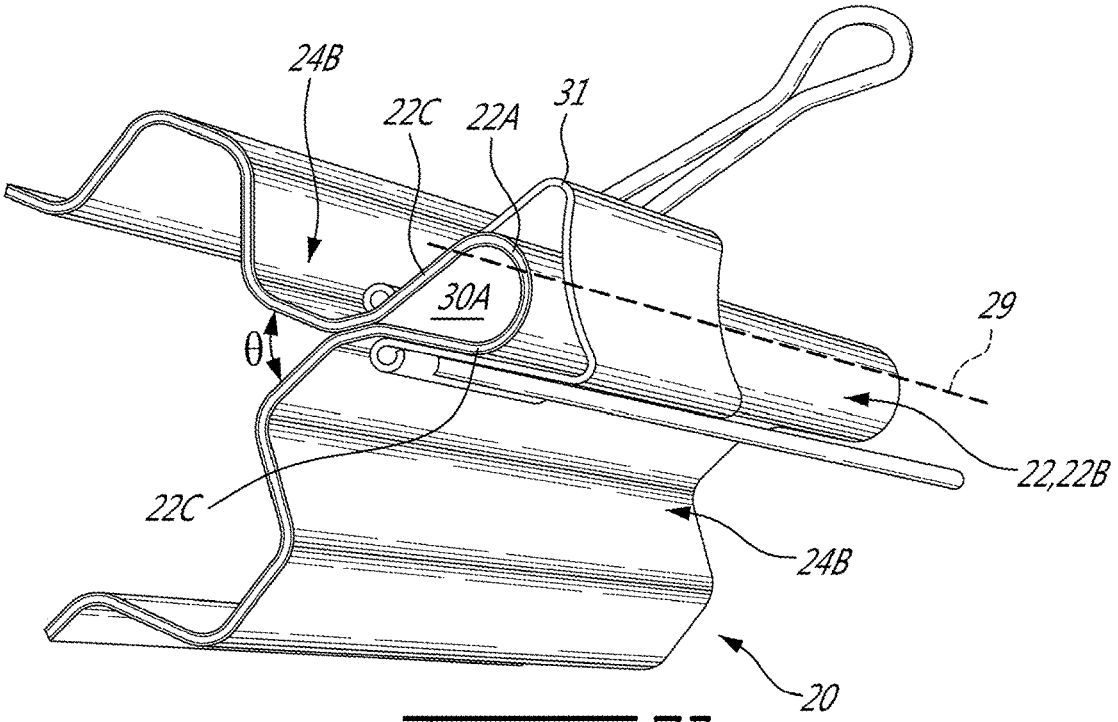
FIG. 2B is a perspective view of the sheet of FIG. 1A with a fold line in another yet folded shape.

Referring to FIG. 2B, the fold line 29 is defined by folding the summit portion 22. The sheet 20 is not scored, and is flexed at the fold line, similarly to the embodiment presented at FIG. 1C. The folded shape of the sheet 20 forms generally an L-shape, where the opposed wings of the sheet 20 form an inner angle $\Theta$ of about 90°. In the depicted embodiment, the resilient flexibility of the sheet 20 requires that a clip 31 be used to hold its folded shape. The valley portions 24B immediately adjacent to the folded summit portion 22B on either side thereof are abuttable against the side walls 16 of the object 12. More particularly, the trough section 24A of each adjacent valley portion 24B can be placed in contact with the side walls 16. The valley portions 24 positioned further away from the folded summit portion 22B do not have full trough sections 24A, such that only a portion of these trough sections 24A can abut against the side walls 16. The apex section 22A is sharply rounded in the depicted embodiment, which may help to deflect impact forces away from the corner 14.

Referring to FIGS. 2A and 2B, the fold line 29, 129 in the apex section 22A of the folded sheet 20 delimits two adjacent sections 22C of the folded summit portion 22B. The adjacent sections 22C abut one another. When they are abutted together, the adjacent section 22C and the apex section 22A circumscribe a second inner space 30A of the folded summit portion 22B. A protective air gap is formed in the second inner space 30A, which provides cushioning and/or insulation, and which can be filled with material such as foam or concrete if desired.

Figure 3:
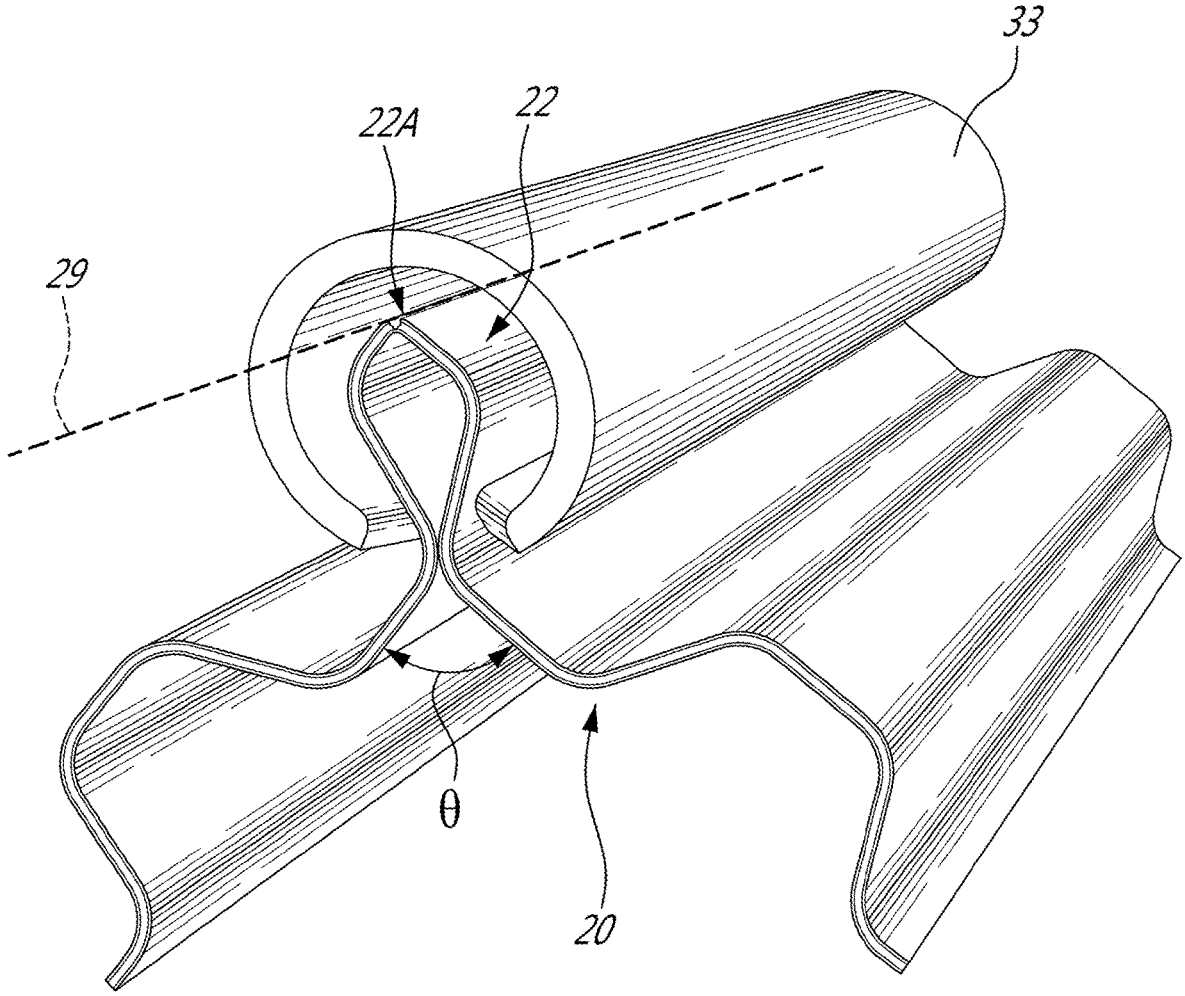
FIG. 3 is a perspective view of the sheet of FIG. 1A with a fold line in another yet folded shape and positioned within a shape holder.

Referring to FIG. 3, the fold line 29 is defined by folding the summit portion 22. The folded shape of the sheet 20 forms generally an L-shape, where the opposed wings of the sheet 20 form an inner angle $\Theta$ of about 90°. In the depicted embodiment, the resilient flexibility of the sheet 20 requires that a slotted tube 33 be used to hold its position in the folded shape. The apex section 22A is relatively pointed in the depicted embodiment, which may help to deflect impact forces away from the corner 14.

Figure 4B:
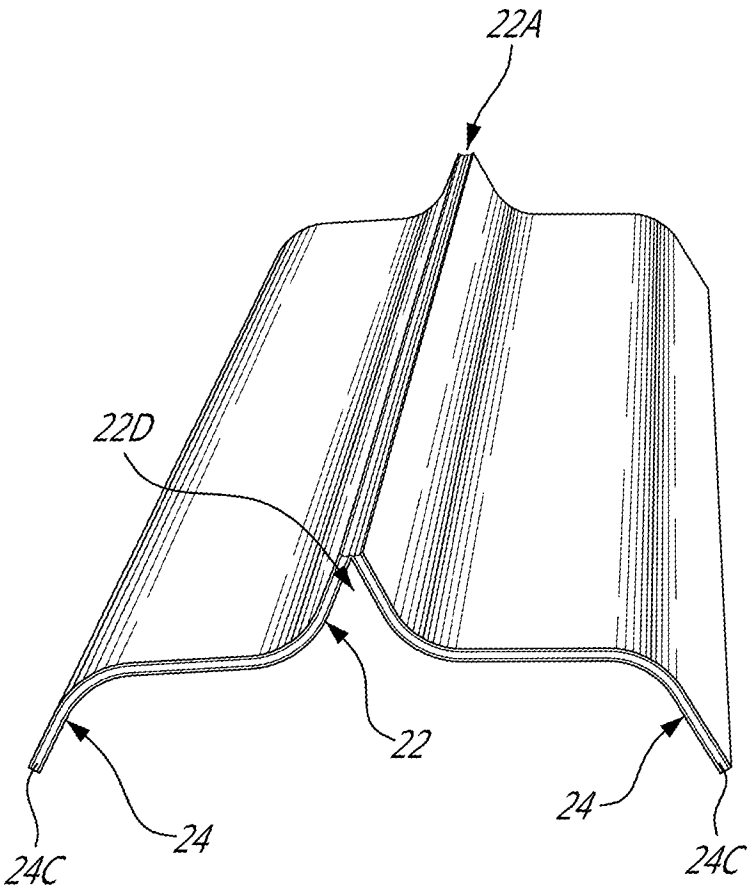
FIG. 4B is a perspective view of the sheet of FIG. 4A with a score line in yet another folded shape.
Figure 4A:
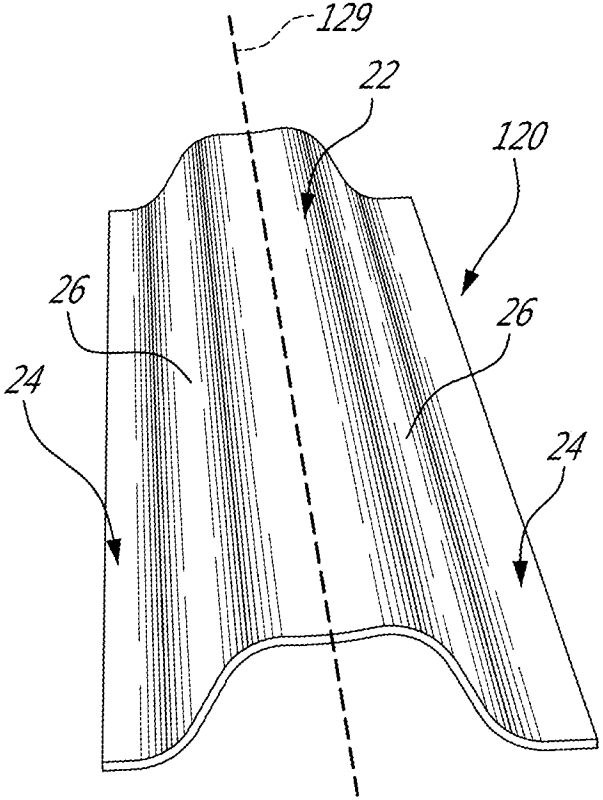
FIG. 4A is a perspective view of a flexible sheet of a corner protector, according to another embodiment of the present disclosure.

Another embodiment of the sheet 120 is shown in FIGS. 4A and 4B. The sheet 120 has one summit portion 22, two half valley portions 24 on either side thereof, and two intermediate portions 26. The sheet 120 is shown in an unfolded configuration in FIG. 4A, and in its folded shape in FIG. 4B. The sheet 120 is foldable about the fold line 129 along a length of its summit portion 22 to form the folded shape. In the depicted embodiment, the fold line 129 is formed by scoring the sheet 120. The sheet 120 is folded about the scored fold line 129 in an outward manner, by folding the half valley portions 24 toward and past the apex section 22A. The folded shape in FIG. 4B thus formed is a bracket for being positioned against the corner of the object.

The peripheral edges 24C of the valley portions 24 can be abutted against the side walls of the object, and the apex section 22A of the folded summit portion 22B is positioned to be spaced outwardly from the corner of the object. The corner of the object is insertable into a pocket 22D defined by the apex section 22A.

Figure 5:
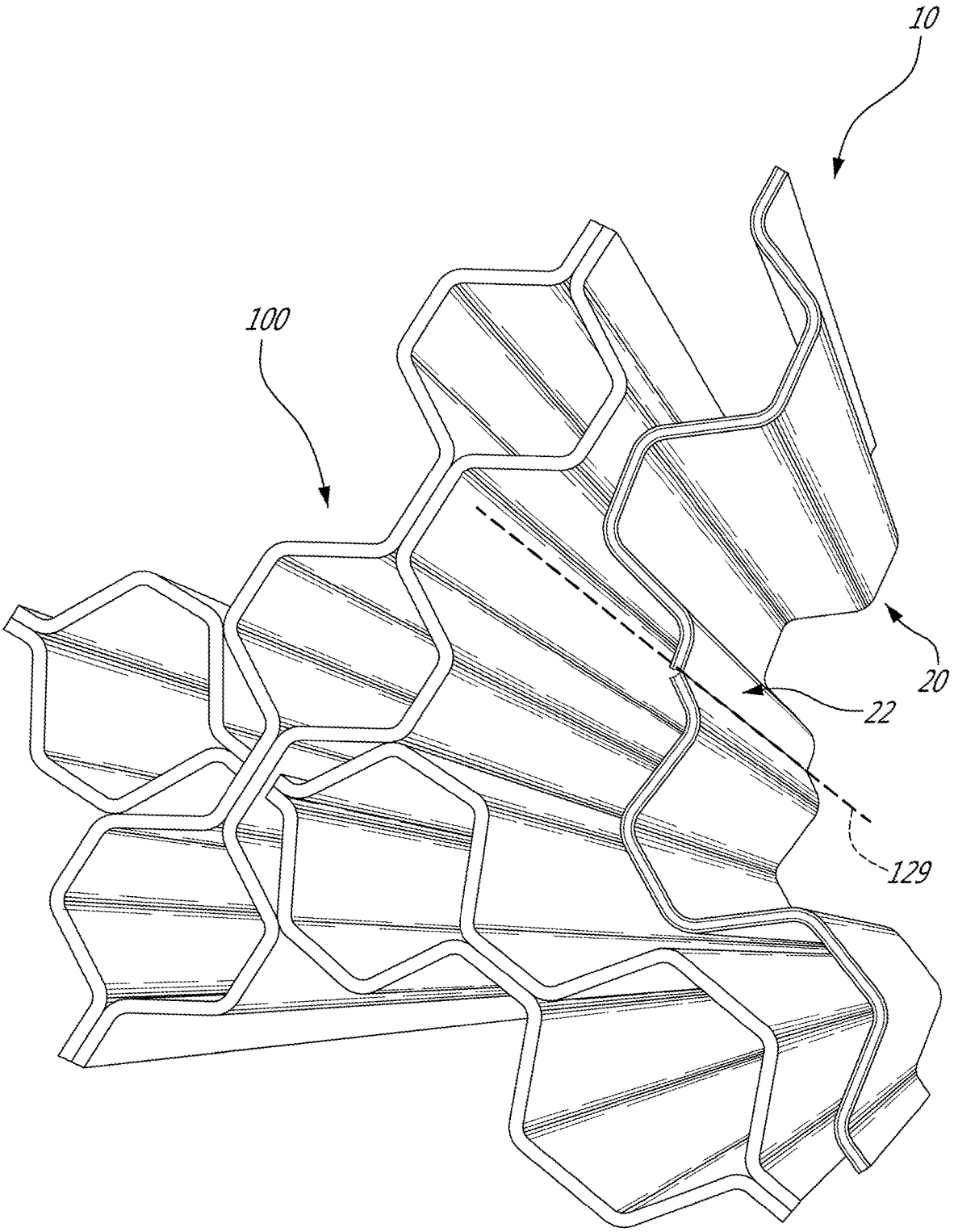
FIG. 5 is a perspective view of the sheet of FIG. 1A with a score line in yet another folded shape.

FIG. 5 shows another folded shape for the sheet 20. The protector 10 in this embodiment is used as a liner for another corner protector structure 100. The sheet 120 is foldable about the fold line 129 along a length of its summit portion 22 to form the folded shape. In the depicted embodiment, the fold line 129 is formed by scoring the sheet 120. The sheet 120 is folded about the scored fold line 129 in an outward manner, similarly to as shown in FIG. 4B. The folded shape in FIG. 5 thus formed is a liner shaped to span along the corner protector structure 100.

In light of the preceding, it can be appreciated that the protector 10 disclosed herein can be provided as a sheet 20, 120, and thus occupies very little volume when being transported. A single sheet 20, 120 can provide many different forms of the corner protector 10 to adapt to different corners and different protection requirements. For example, a single object 12 having different corners 14 or different protection requirements for its corners 14 can be provided with a different corner protector 10 for each of its corners, where each corner protector 10 is made from the same sheet. The corner protector 10 can therefore be mass produced as a sheet 20, 120 in an unfolded configuration, but still highly customisable as different types of folded shapes on site.

As can be understood, the examples described above and illustrated are intended to be exemplary only. The scope is indicated by the appended claims.

What is claimed is:

1. A corner protector for protecting a corner of an object, comprising: a flexible sheet having an undulated shape with summit portions, valley portions, and intermediate portions each extending between corresponding summit and valley portions, at least the summit portions being identical to one another, the sheet being foldable along a length of at least one of the summit portions to form a folded shape for the sheet corresponding to a shape of the corner, the valley portions of the sheet in the folded shape being abuttable against side walls of the object intersecting at the corner, an apex section of the at least one of the summit portions in the folded shape being spaced from the corner of the object upon the valley portions abutting the side walls.

2. The corner protector as defined in claim 1, wherein in the folded shape, the at least one of the summit portions and the valley portions immediately adjacent thereto circumscribe an inner space of the at least one of the summit portions.

3. The corner protector as defined in claim 1, wherein the apex sections of the remaining summit portions in the folded shape are spaced apart from the side walls of the object upon the valley portions abutting the side walls.

4. The corner protector as defined in claim 1, further comprising a score line extending along the length of the at least one of the summit portions, the score line defining an axis about which the at least one of the summit portions is foldable.

5. The corner protector as defined in claim 4, wherein the sheet includes a rigid inner layer sandwiched between flexible outer layers, the score line being defined upon cutting through one of the flexible outer layers and the rigid inner layer of the at least one of the summit portions.

6. The corner protector as defined in claim 5, wherein the inner and outer layers are free of corrugation.

7. The corner protector as defined in claim 5, wherein the inner layer includes a wood veneer having wood fibers.

8. The corner protector as defined in claim 5, wherein the outer layers include a paper liner.

9. A corner protector for protecting a corner of an object, comprising: a flexible sheet having an undulated shape with summit portions, valley portions, and intermediate portions each extending between corresponding summit and valley portions, the sheet being foldable along a length of at least one of the summit portions to form a folded shape for the sheet corresponding to a shape of the corner, the valley portions of the sheet in the folded shape being abuttable against side walls of the object intersecting at the corner, an apex section of the at least one of the summit portions in the folded shape being spaced from the corner of the object upon the valley portions abutting the side walls, a fold line is defined upon folding the sheet along the at least one of the summit portions, the fold line delimiting two adjacent sections of the at least one of the summit portions, the adjacent sections of in the folded shape abutting one another.

10. The corner protector as defined in claim 9, wherein in the folded shape, the abutting adjacent sections and the apex section of the at least one of the summit portions circumscribe a second inner space of the at least one of the summit portions.

11. A method for protecting a corner of an object, comprising:

folding an undulated, flexible sheet along a length of at least one summit portion of the sheet to correspond to a shape of the corner, and so that two adjacent sections of the at least one summit portion abut one another; and positioning the folded sheet about the corner, valley portions of the folded sheet abutting against side walls of the object intersecting at the corner, an apex section of the at least one summit portion being spaced from the corner.

12. The method as defined in claim 11, wherein folding the sheet includes folding the sheet to circumscribe an inner space between the at least one summit portion and the valley portions immediately adjacent thereto.

13. The method as defined in claim 11, wherein folding the sheet includes scoring the sheet along the length of the at least one summit portion.

14. The method as defined in claim 11, wherein positioning the folded sheet includes positioning the folded sheet between the object and a container for transporting the object.

* * * * *